US007183927B2

(12) United States Patent
Kolton et al.

(10) Patent No.: US 7,183,927 B2
(45) Date of Patent: Feb. 27, 2007

(54) ELECTRONIC ARTICLE SURVEILLANCE MARKER ASSEMBLY

(75) Inventors: Chester Kolton, Westfield, NJ (US); Michael Norman, East Brunswick, NJ (US); Robert Whittemore, Middletown, NY (US); Andrew A. Au, Hong Kong (HK)

(73) Assignee: B&G Plastics, Inc., Newark, NJ (US)

( * ) Notice: Subject to any disclaimer, the term of this patent is extended or adjusted under 35 U.S.C. 154(b) by 333 days.

(21) Appl. No.: 10/721,519

(22) Filed: Nov. 24, 2003

(65) Prior Publication Data

US 2005/0110642 A1 May 26, 2005

(51) Int. Cl.
*G08B 13/14* (2006.01)

(52) U.S. Cl. ..... 340/572.8; 340/572.9; 340/571; 340/568.1; 235/491

(58) Field of Classification Search ..... 340/572.8, 340/572.9, 571, 568.1; 235/491, 492
See application file for complete search history.

(56) References Cited

U.S. PATENT DOCUMENTS 5,945,909 A 8/1999 Kolton
6,137,413 A * 10/2000 Ryan, Jr. ..... 340/572.8

* cited by examiner

*Primary Examiner*—Tai Nguyen
(74) *Attorney, Agent, or Firm*—Hoffmann & Baron, LLP

(57) ABSTRACT

An electronic article surveillance assembly comprises a housing containing an electronic article surveillance marker, the housing defining a viewability channel extending between opposed first and second exterior surfaces of the housing, the electronic article surveillance marker being disposed aside the viewability channel. In a combination, there is provided an article of manufacture and an electronic article surveillance assembly comprising a housing containing an electronic article surveillance marker, the housing defining a viewability channel extending between opposed first and second exterior surfaces of the housing, the electronic article surveillance marker being disposed aside the viewability channel, the article of manufacture having a bottom portion thereof disposed in the housing in registry with the viewability channel.

16 Claims, 2 Drawing Sheets

ELECTRONIC ARTICLE SURVEILLANCE MARKER ASSEMBLY

FIELD OF THE INVENTION

This invention relates generally to security from shoplifting of articles of manufacture and pertains more particularly to electronic article surveillance marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

Commonly-assigned U.S. Pat. No. 5,945,909 discloses a so-called "seal" comprising a one-piece body having first and second members closable one upon the other and thereupon respectively defining first and second outer seal walls and a tail peripherally continuous with at least one of the first and second members at a third outer seal wall, the tail having a hook at a free end thereof. The seal body defines an interior recess and a detent opening into the third outer seal wall for retentive reception of the tail hook interiorly of the seal. An EAS marker is disposed in the seal body recess and is contained therein between the first and second outer seal walls upon closure of the first and second members.

The '909 patent seal is used by circumscribing a portion of an article, e.g., a watchband, with the tail and then inserting the tail hook into the seal body detent.

The EAS marker is a flat ferromagnetic strip member and is detectable by various known EAS systems, e.g., where the marker is not deactivated (as at an article payment checkout counter) and is carried through EAS marker detection gates at a facility exit.

SUMMARY OF THE INVENTION

The present invention has as its primary object the provision of an EAS marker assembly adapted for use with articles of manufacture having information thereon which need be readable by a customer.

By way of example of such a article of manufacture, baby formula containers have a tubular body portion having a metallic bottom portion bearing indication of expiration date for safe usage of the baby formula.

In attaining the foregoing and other objects, the invention provides an electronic article surveillance assembly comprising a housing containing an electronic article surveillance marker, the housing defining a viewability channel extending between opposed first and second exterior surfaces of the housing, the electronic article surveillance marker being disposed aside the viewability channel. The housing defines a first opening extending through the first exterior surface, a second opening extending through the second exterior surface, the housing defining a passage communicating with the first and second openings, the viewability channel being constituted by the first opening, the passage and the second opening.

The invention further provides, in combination, an article of manufacture and an electronic article surveillance assembly comprising a housing containing an electronic article surveillance marker, the housing defining a viewability channel extending between opposed first and second exterior surfaces of the housing, the electronic article surveillance marker being disposed aside the viewability channel, the article of manufacture having a bottom portion thereof disposed in the housing in registry with the viewability channel.

The invention will be further understood from consideration of the following description of preferred embodiments thereof and from the drawings where like reference numerals identify like parts throughout.

DETAILED DESCRIPTION OF THE PREFERRED EMBODIMENT

Figure 1:
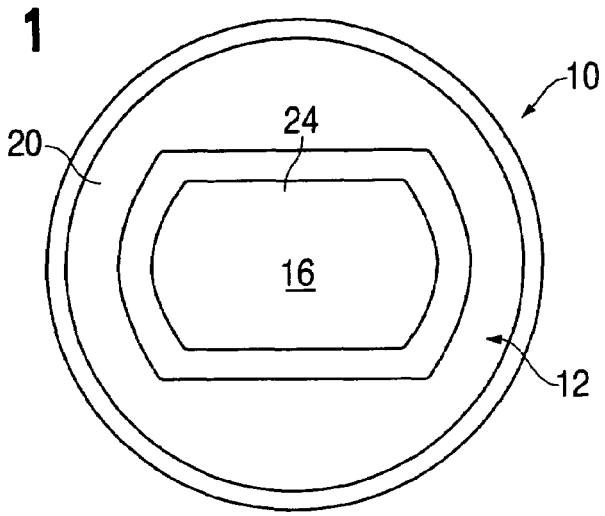
FIG. 1 is a top plan view of an EAS assembly in accordance with the invention.
Figure 2:
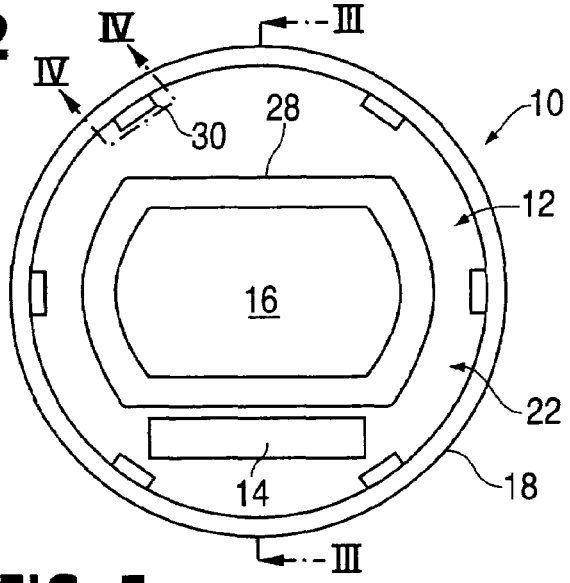
FIG. 2 is a bottom plan view of the EAS assembly of FIG. 1.
Figure 3:
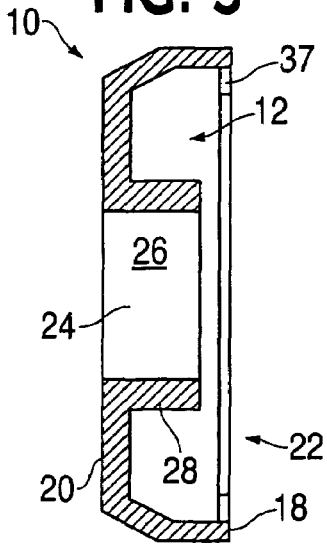
FIG. 3 is a sectional view of the EAS assembly of FIG. 1 as would be seen from plane III—III of FIG. 1.

Referring to FIGS. 1–3, electronic article surveillance assembly 10 comprises housing 12, containing electronic article surveillance marker 14.

Housing 12 defines viewability channel 16 extending between opposed first and second exterior surfaces 18 and 20 of the housing, electronic article surveillance marker 14 being disposed aside viewability channel 16. Housing 12 is comprised of an opaque plastic material, whereby marker 14 is not viewable through first exterior surface 18.

Housing 12 defines a first opening 22 extending through first exterior surface 18, a second opening 24 extending through second exterior surface 20, the housing defining a passage 26 communicating with first and second openings 22 and 24. Viewability channel 16 is constituted by first opening 22, passage 26 and second opening 24.

Housing 12 defines interior structure 28 at least in part bounding passage 26 and extending contiguously from first exterior surface 18 and recessed relative to first exterior surface 18.

Spaced about the interior of housing 12 are a plurality of retention means 30, disposed in the housing 12 adjacent first exterior surface 18 and in registry with the recess between the housing interior structure 28 and first exterior surface 18.

Figure 4:
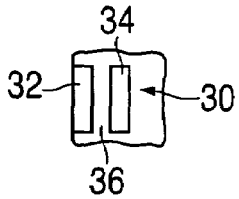
FIG. 4 is a partial view as would be seen from plane IV—IV of FIG. 1.

One embodiment of retention means 30 is shown in FIG. 4, comprising a first rib 32 contiguous with first exterior surface 18 and a second rib 34 spaced downwardly of first rib 32, the ribs (retaining elements) defining retention groove 36 therebetween.

Alternatively, retention means 30 may comprise an adhesive 37 (FIG. 3) applied to the inner periphery of housing 12. The invention contemplates joint use of ribs 32 and 34 and adhesive 37.

Figure 5:
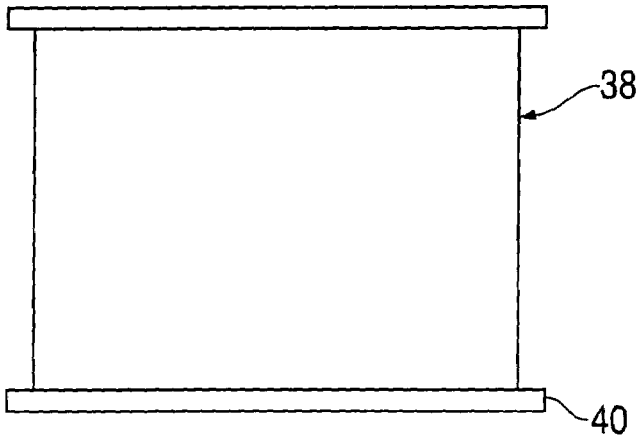
FIG. 5 (PRIOR ART)
FIG. 5 is a front elevation of a known article of manufacture.

Turning to FIG. 5, article of manufacture 38 is the afore-mentioned baby formula container having a tubular body portion with a metallic bottom portion 40 bearing indication of expiration date for safe usage of the baby formula.

Figure 6:
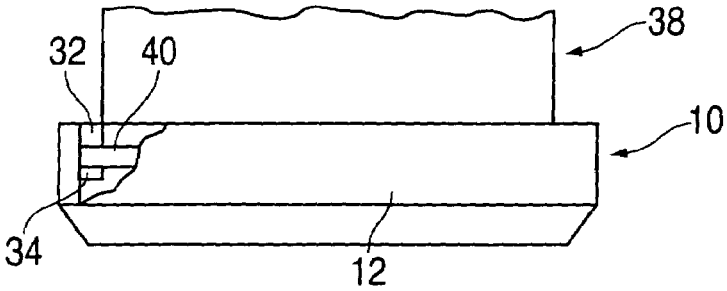
FIG. 6 is a view showing the assembly of the EAS marker of FIGS. 1–4 with the article of manufacture of FIG. 5, partly broken away to show interior detail.

In FIG. 6, bottom portion 40 is shown inserted through housing second exterior surface 20 into housing 12. In the course of such insertion, bottom portion 40 nests retentively between ribs 32 and 34, fully peripherally of housing 12, thereby securing housing 12 to article of manufacture 38. As above alluded to, the securement of bottom portion 40 with housing 12 may be effected also, or otherwise, by adhesive 37. Expiration date or like information on bottom portion 40 is viewable through viewability channel 16 (FIG. 1) when the assembly of FIG. 6 is effected.

Various changes may be introduced in the disclosed preferred embodiment without departing from the invention. By way of example, interior structure 28 effectively provides sufficient spacing between EAS marker 14 and metallic bottom portion 40 so that the EAS marker is isolated from influence of the metal of bottom portion 40 such that the marker can be deactivated at checkout. Where the article portion bearing the expiration date is not metal, e.g., is comprised of plastic, the interior structure may be shortened in length. Accordingly, it is to be appreciated that the true spirit and scope of the invention is set forth in the following claims.

What is claimed is:

1. An electronic article surveillance assembly for securement to an article of manufacture, said article having viewable information located thereon, said assembly comprising:

a housing containing an electronic article surveillance marker, said housing defining a viewability channel extending between opposed first and second exterior surfaces of said housing for viewing of said information located on said article when said assembly is secured to said article, said electronic article surveillance marker being disposed aside said viewability channel when said assembly is secured to said article.

2. The electronic article surveillance assembly claimed in claim 1, wherein said housing defines a first opening extending through said first exterior surface, a second opening extending through said second exterior surface, said housing defining a passage communicating with said first and second openings, said viewability channel being constituted by said first opening, said passage and said second opening.

3. The electronic article surveillance assembly claimed in claim 2, wherein said housing defines interior structure at least in part bounding said passage and extending contiguously from said first exterior surface.

4. The electronic article surveillance assembly claimed in claim 3, wherein said housing interior structure is recessed relative to said second exterior surface.

5. The electronic article surveillance assembly claimed in claim 4, wherein said housing defines retention means for securing an article of manufacture to said housing, said retention means being disposed in said housing adjacent said second exterior surface and in registry with the recess between said housing interior structure and said second exterior surface.

6. The electronic article surveillance assembly claimed in claim 5, wherein said retention means comprises a plurality of retaining elements extending interiorly of said housing from a periphery of said housing.

7. The electronic article surveillance assembly claimed in claim 5, wherein said retention means comprises an adhesive extending interiorly of said housing from a periphery of said housing.

8. The electronic article surveillance assembly claimed in claim 5, wherein said retention means comprises a plurality of retaining elements and an adhesive extending interiorly of said housing from a periphery of said housing.

9. In combination:

(a) an article of manufacture; and (b) an electronic article surveillance assembly comprising a housing containing an electronic article surveillance marker, said housing defining a viewability channel extending between opposed first and second exterior surfaces of said housing, said electronic article surveillance marker being disposed aside said viewability channel, said article of manufacture having a bottom portion thereof disposed in said housing in registry with said viewability channel.

10. The invention claimed in claim 9, wherein said housing defines a first opening extending through said first exterior surface, a second opening extending through said second exterior surface, said housing defining a passage communicating with said first and second openings, said viewability channel being constituted by said first opening, said passage and said second opening.

11. The invention claimed in claim 10, wherein said housing defines interior structure at least in part bounding said passage and extending contiguously from said first exterior surface.

12. The invention claimed in claim 11, wherein said housing interior structure is recessed relative to said second exterior surface, bottom portion of said article of manufacture being resident in such recess and exteriorly bounded by said housing.

13. The invention claimed in claim 12, wherein said housing defines retention means for securing said bottom portion of said article of manufacture to said housing, said retention means being disposed in said housing adjacent said second exterior surface and in registry with the recess between said housing interior structure and said second exterior surface.

14. The invention claimed in claim 13, wherein said retention means comprises a plurality of retaining elements extending interiorly of said housing from a periphery of said housing.

15. The invention claimed in claim 14, wherein said retention means comprises an adhesive extending interiorly of said housing from a periphery of said housing.

16. The invention claimed in claim 15, wherein said retention means comprises a plurality of retaining elements and an adhesive extending interiorly of said housing from a periphery of said housing.

* * * * *